US005335705A

United States Patent [19]

Morishita et al.

[11] Patent Number: 5,335,705

[45] Date of Patent: Aug. 9, 1994

[54] APPARATUS FOR DISPENSING A SPARKLING OR BUBBLING BEVERAGE

[75] Inventors: Akira Morishita; Tsuyoshi Ota, both of Numazu; Tatsuya Suzuki, Shizuoka; Sukehide Ito, Numazu; Yoshikazu Ryuko, Shizuoka, all of Japan

[73] Assignee: Toshiba Machine Co., Ltd., Tokyo, Japan

[21] Appl. No.: 906,496

[22] Filed: Jun. 30, 1992

[30] Foreign Application Priority Data

Sep. 27, 1991 [JP] Japan ..... 3-249778

[51] Int. Cl.[5] ..... B67D 1/04

[52] U.S. Cl. ..... 141/275; 141/67; 141/104; 141/302; 141/82; 141/83; 141/198; 141/377; 222/54; 222/61; 222/146.6; 222/399

[58] Field of Search ..... 141/18, 21, 250, 267–269, 141/271, 272, 275–278, 302, 369–371, 373, 377, 378, 104, 67, 100, 192, 198, 47, 63, 64, 82, 83, 94, 95, 128; 222/54, 61, 146.6, 399

[56] References Cited

U.S. PATENT DOCUMENTS

| | | | |
|---|---|---|---|
| 307,562 | 11/1884 | Matthews | 141/82 |
| 719,846 | 2/1903 | Neubert et al. | 222/399 X |
| 2,757,846 | 8/1956 | Varrin . | |
| 2,880,912 | 4/1959 | Fisher | 141/104 X |
| 4,869,396 | 9/1989 | Horino et al. | 222/54 |
| 5,086,817 | 2/1992 | Murphy | 141/271 |

FOREIGN PATENT DOCUMENTS

| | | | |
|---|---|---|---|
| 0424682 | 5/1991 | European Pat. Off. . | |
| 3220685 | 12/1982 | Fed. Rep. of Germany . | |
| 3524645 | 1/1986 | Fed. Rep. of Germany . | |
| 3607328 | 9/1987 | Fed. Rep. of Germany | 141/198 |
| 3828615 | 3/1989 | Fed. Rep. of Germany . | |
| 3932250 | 4/1991 | Fed. Rep. of Germany | 141/271 |
| 61-7998 | 1/1986 | Japan . | |
| 62-64790 | 3/1987 | Japan . | |
| 64-42300 | 3/1989 | Japan . | |
| 1-38072 | 11/1989 | Japan . | |
| 8902990 | 7/1991 | Netherlands | 141/198 |

*Primary Examiner*—J. Casimer Jacyna

*Attorney, Agent, or Firm*—Oblon, Spivak, McClelland, Maier & Neustadt

[57] ABSTRACT

After a container is placed on a rest base beneath a beverage dispensing section where a dispensing outlet is provided, a dispensing button is depressed and a stepping motor constituting a base tilting drive device is driven for a predetermined time period to cause a linear head to be extended so that the rest base and hence a container is tilted as one unit. A dispensing valve drive device is operated to open a dispensing valve and dispense a bubbling beverage along an inner wall of the container, while suppressing any excessive formation of bubbles. When a bubble surface or liquid level of the beverage dispensed into the container rises to a predetermined level, the stepping motor is reversely driven to bring the container to an erect state. When the container becomes full with the beverage, the dispensing valve is closed, stopping the dispensing of the beverage.

10 Claims, 6 Drawing Sheets

APPARATUS FOR DISPENSING A SPARKLING OR BUBBLING BEVERAGE

BACKGROUND OF THE INVENTION

1. Field of the Invention

The present invention relates to an apparatus for dispensing a sparkling or bubbling beverage containing a carbon dioxide, such as draft beer, into a container and, in particular, to an apparatus for forcing a bubbling beverage from a beverage tank under a $CO_2$ gas pressure into a container in a predetermined quantity.

2. Description of the Related Art

Various drinks, such as draft beer, coke and juice, are known as a sparkling, $CO_2$ gas-containing beverage to be handled by a dispensing apparatus. Here, a draft beer dispensing apparatus will be explained below by way of example.

This type of dispensing apparatus is disclosed in Published Examined Japanese Utility Model Registration H-1-38072.

The aforementioned apparatus is of such a type that an opening/closing valve for opening/closing a beverage passage leading to a dispensing outlet can be operated, by the operator, through an operation lever so that a proper quantity of draft beer can be dispensed into a container, such as a mug.

The operator, while dispensing draft beer by hand-operating the operation lever, adjusts the extent of bubbles in the beer by varying a positional distance to the dispensing outlet of the container, such as a "height" or a "tilt" angle, by the other hand of the operator.

In this dispensing apparatus, the amount of beer to be dispensed as well as the extent of bubbles in the beer depends mainly upon the extent of adjustment by the operator, thus requiring a considerable experience.

Recently, a dispensing apparatus has been developed and reduced to practice which is of such a type as to be equipped with dispensing buttons (selection switches), in place of the operation lever, for containers of different size. The apparatus enables the dispensing valve to be opened for a period of time corresponding to the size of the container, by selectively pressing a corresponding dispensing button, so that a mugful of beer is dispensed.

This type of apparatus, like other conventional apparatuses, can dispense beer, while a container is being hand-gripped, so that a different amount of bubbles is dispensed into a corresponding mug according to how to hand-grip the mug. Opening the dispensing valve for only a period of time corresponding to the size of the mug sometimes causes beer to be overflowed out of the mug, thus requiring a higher technique in dispensing a proper amount of beer into the mug.

As well-known, a given amount of $CO_2$ gas is contained in the draft beer and, unless being placed under a proper pressure against the temperature of the draft beer, a $CO_2$ gas is either released or bubbled. Conversely, the $CO_2$ gas is sometimes excessively absorbed in the draft beer, thus markedly lowering the sense of taste.

It is, therefore, necessary that, in order to dispense tasty draft beer, a gas pressure appropriate to the temperature of the draft beer be applied to the interior of a beverage tank (a storage tank) in which the draft beer is held.

The existing apparatus is, therefore, adapted to detect, through a temperature sensor, a temperature level prevailing in the draft beer tank and to display a corresponding gas pressure level on a display unit. The operator has adjusted the gas pressure acting upon the interior of the beer tank, while seeing the data on the display surface of the display unit.

The hand adjustment of the gas pressure by the operator poses a problem that doing so is very cumbersome and, in addition, is often forgotten inadvertently,

SUMMARY OF THE INVENTION

A first object of the present invention is to provide a sparkling or bubbling beverage dispensing apparatus which can automatically and controllably dispense the beverage in a proper liquid/bubble amount ratio without hand-gripping a beverage-containing tank by an operator and do so by a very simple operation.

A second object of the present invention is to provide a sparkling or bubbling beverage dispensing apparatus which can automatically dispense the beverage under a proper $CO_2$ gas pressure level corresponding to a temperature prevailing in a beverage-containing tank and do so, while at all times maintaining, to a proper level, an amount of $CO_2$ which is dissolved in the beverage.

In order to achieve the aforementioned object of the present invention, there is provided an apparatus for dispensing a sparkling or bubbling beverage, comprising:

an apparatus body having a beverage dispensing section where a dispensing outlet is provided for dispensing the bubbling beverage;

gas supplying means for supplying a $CO_2$ gas into a beverage-containing tank;

a beverage passage for drawing the beverage from the tank toward the dispensing outlet by a pressure of the $CO_2$ gas which is supplied from the gas supply means;

beverage cooling means for cooling the bubbling beverage which is drawn via the beverage passage toward the dispensing outlet;

a dispensing valve for opening/closing the beverage passage leading to the dispensing outlet;

a dispensing valve drive device for driving the dispensing valve to allow the dispensing valve to be opened or closed;

a rotatably displaceable rest base mounted below the beverage dispensing section with a beverage container placeable so that the beverage is dispensed into the beverage container;

a base tilting drive device for tilting the rest base;

dispensing start signal input means for inputting a signal for starting the dispensing of the beverage into the container on the rest base; and a controller for controlling an operation of the dispensing valve drive means and base tilting drive device by the signal input by the dispensing start signal input means.

The present invention can automatically and controllably dispense a sparkling beverage in a proper liquid/bubble amount ratio without hand-tilting the container and giving a height difference relative to the dispensing outlet.

According to the present invention, an intratank gas pressure controller is provided for controlling a pressure in the beverage tank in accordance with a temperature of the sparkling beverage leading to the beverage cooling means.

It is possible, according to the present invention, to automatically and positively adjust a $CO_2$ gas pressure to a proper level in accordance with a temperature of the sparkling beverage.

It is, therefore, possible to automatically and positively adjust the $CO_2$ gas pressure to a proper level corresponding to a temperature of the beverage and hence maintain an amount of $CO_2$ gas dissolved in the beverage at a proper level at all times.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawing, which is incorporated in and constitutes a part of the specification, illustrates a presently preferred embodiment of the invention and, together with the general description given above and the detailed description of the preferred embodiment given below, serves to explain the principles of the invention.

DETAILED DESCRIPTION OF THE PREFERRED EMBODIMENT

One embodiment of the present invention will be explained below with reference to the accompanying drawings.

Figure 1:
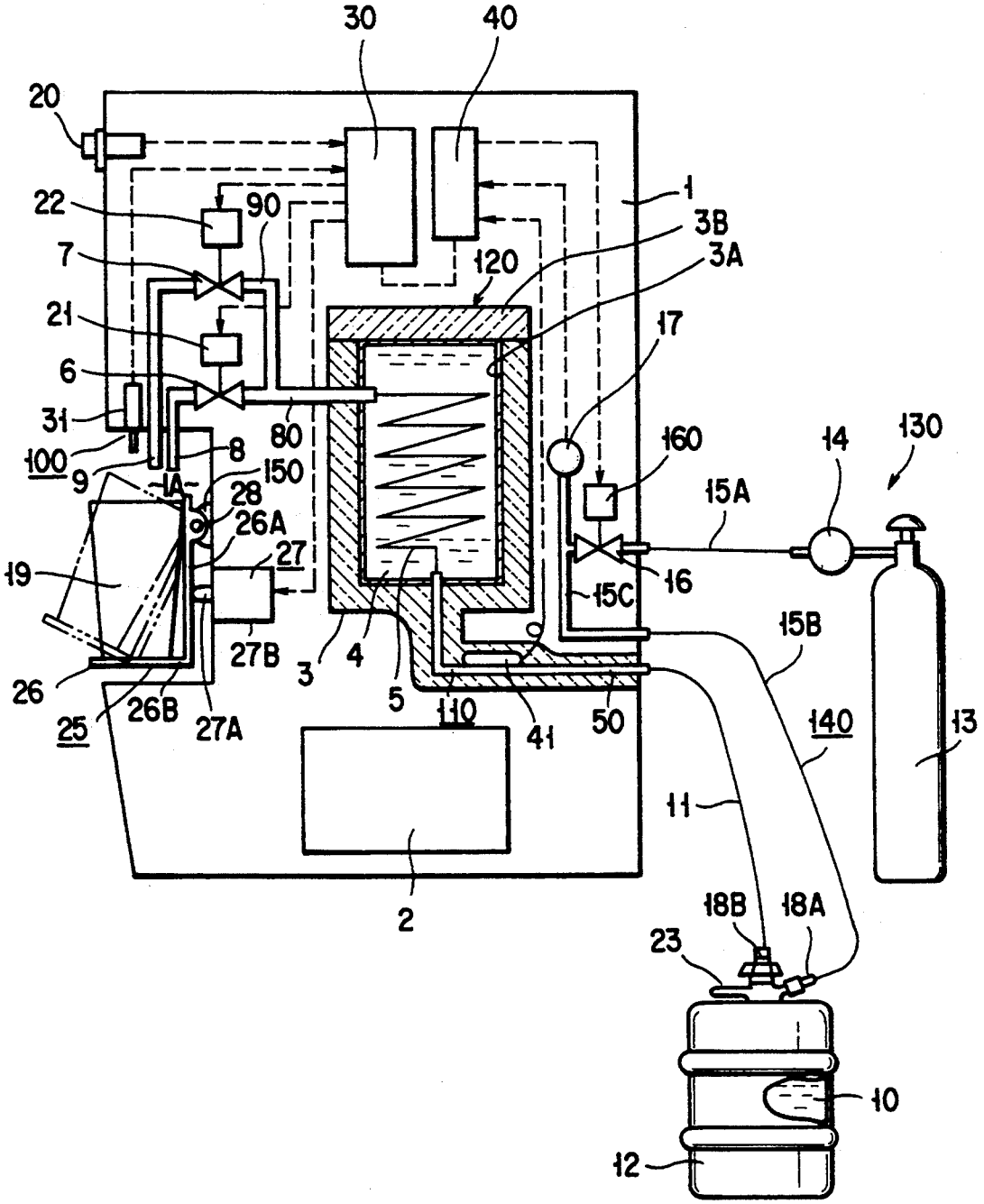
FIG. 1 is a diagrammatic view showing one embodiment of the present invention.

In FIG. 1, reference numeral 1 shows a dispensing apparatus body having a recess 1A at a central area on a front side of the apparatus body 1. A dispensing unit 100 is provided in that top area of the recess 1A where a dispensing outlet 8, a bubble outlet 9 and liquid level detector 31 are provided. A container support means 25 is provided below the dispensing unit 100 in the recess 1A to support a container 19, such as a mug.

A dispensing button 20 is provided at an upper area of the front side of the apparatus body 1 and serves as a dispensing start signal input means.

In the apparatus body 1 are provided a beverage passage 110 for allowing a sparkling or bubbling beverage (in this case, draft beer) which is drawn from a beverage tank (in this case, a cask) 12 to be fed to the dispensing outlet 8 and bubble dispensing outlet 9 and a beverage cooling means 120 for cooling the beverage 10 fed to the beverage dispensing outlet 8 and bubble dispensing outlet 9 via the beverage passage 110.

The beverage passage 110 comprises a beverage cooling tube 5 connected to the beverage tank 12 via a beverage introducing tube 11, a beverage drawing tube 80 connected at one end to the beverage cooling tube 5 and at the other end to the beverage dispensing output 8, and a bubble drawing tube 90 which is branched from the beverage drawing tube 80 and opened at the bubble dispensing outlet 9 at the other-end side.

The beverage cooling means 120 comprises a cooling water tank 3 containing a cooling water 4 for a heat exchange at the beverage cooling tube 5 and a cooling device 2 for cooling a cooling water 4 in the cooling water tank 3.

The cooling water 3 comprises a cooling container 3A and a heat insulating material 3B surrounding the outside of the container 3A. An evaporation tube, not shown, of the cooling device 2 is wound on the inside of the container 3A and adapted to cool the water 4 in the cooling tank 3 by latent heat upon evaporation of a coolant, not shown, flowing through the evaporation tube.

A dispensing valve 6 is provided at the beverage drawing tube 80 leading to the beverage cooling tube 5 to allow the valve 6 to be opened and closed. A bubble valve 7 is provided at the bubble drawing tube 90 to allow the valve 7 to be opened and closed.

A dispensing head 23 is detachably mounted on the beverage drawing outlet of the beverage tank 12 and includes a gas inlet 18A and beverage drawing outlet. The dispensing head 23 is connected to a siphon tube, not shown, provided in the beverage tank 12.

A gas introducing tube 15B of a gas supplying means 130 as will be set out below is connected to the gas inlet 18A at the dispensing head 23. A $CO_2$ gas is supplied into the beverage tank 12. The beverage introducing inlet 11 is connected to a beverage drawing section 18B. The sparkling or bubbling beverage (in this case, draft beer) 10 in the beverage tank 12 is pumped to the beverage passage 110 under a pressure of a $CO_2$ gas which is supplied into the beverage tank 12.

The gas supplying means 130 is equipped with a $CO_2$ gas cylinder 13 serving as a $CO_2$ gas supply source. A gas outlet of a constant pressure valve 14 which is mounted on the $CO_2$ gas cylinder 13 is connected to the gas inlet 18A at the dispensing head 23 through a gas drawing passage 140 comprising a gas drawing tube 15A, a gas drawing tube 15C and a gas drawing tube 15B.

A gas pressure adjusting valve 16 serving as a gas pressure adjusting means is mounted on the gas drawing tube 15C fixedly set in the apparatus body 1, noting that the gas drawing tube 15C provides an intermediate section of the gas drawing passage 140. The gas pressure adjusting valve 16 is comprised simply of an opening/closing valve adapted to open and close the aforementioned passage so that the $CO_2$ gas may be supplied and stopped. A pressure sensor 17 acting as a gas pressure detecting means is connected to the gas drawing tube 15C so as to detect the pressure of a $CO_2$ gas supplied into the beverage tank 12.

The container support means 25 provided below the dispensing unit 100 and having the beverage dispensing outlet 8, bubble dispensing output 9 and liquid level detector 31 comprises a rest base 26 and a base tilting drive device 27 constituted by a linear head-equipped stepping motor for tilting the rest base.

The rest base 26 has an L-shaped configuration, that is, a vertical plate section 26A and a horizontal plate section 26B. A shaft 28 is mounted on the upper end portion of a rear surface of the vertical plate section 26A. The shaft 28 is supported on a bearing 150 provided on a vertical wall of the recess 1A set out above and is rotatably displaceable.

The base tilting drive device comprises a linear head 27A serving as a pressing member having its forward end abutted against the rear surface of the vertical plate section 26A of the displaceable rest base 26 to allow the forward end of the pressing member to be moved in a direction to displace the rest base in a right/left direction as shown FIG. 1 and a stepping motor 27B serving as a moving means adapted to move the linear head 27A in a direction to displace the rest base 26 in a right/left direction as shown in FIG. 1.

With the linear head 27A placed in a nonabutting state, the rest base 26 is placed in a non-inclined state as indicated by a solid line in FIG. 1 where the container 19 is placed in a vertical state. With the linear head 27A in an extended position, the rest base 26 is placed in an inclined state as indicated by dash dot lines in FIG. 1, that is, in a position inclined with the shaft 28 as a rotation center. In this case, the container 19 is held at an angle of, for example, 45° at max.

A temperature sensor 41 serving as a temperature detection means is provided, in intimate contact relation, at a beverage drawing tube 50 which is located in a bottom section of the cooling water tank 3 in a manner to communicate with the beverage cooling tube 5. The sensor 41 is adapted to detect the temperature of the beverage 10 at a location upstream of the beverage cooling means 120. The temperature sensor 41 is covered with a heat insulating material integral with the heat insulating material 3B of the cooling water tank 3 and is not affected by an outer atmosphere.

The liquid level detector 31 provided at the beverage dispensing unit 100 is of a photoelectric type, such as a light-reflective type sensor.

At the upper inner portion of the apparatus body are provided a controller 30 for controlling the operation of the apparatus upon the dispensing of the beverage and a gas pressure controller 40 for controlling a pressure in the beverage tank 12 in accordance with the temperature of the beverage 10 leading to the beverage cooling means 120.

Figure 2:
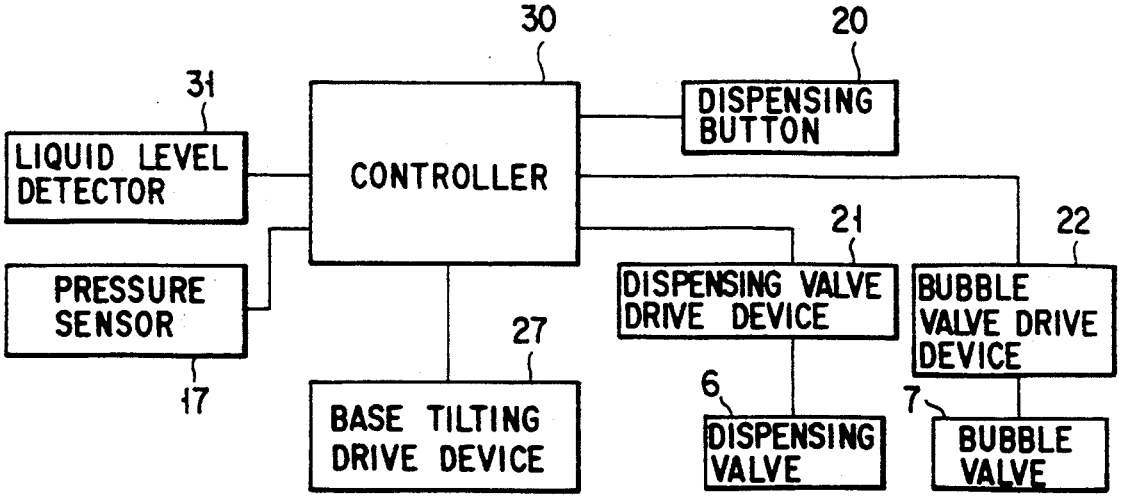
FIG. 2 is a block diagram showing a control system in FIG. 1.

The controller 30, though being not shown in detail, includes a microcomputer and, as shown in FIG. 2, is electrically connected to the base tilting drive device 27, an electromagnetic type dispensing valve drive device 21 for opening and closing the dispensing valve 6, and an electromagnetic type bubble valve drive device 22 for opening and closing the bubble valve 7 so that these devices can be controlled. Further, the dispensing button 20, pressure sensor 17 and liquid level detector 31 are electrically connected to the controller 31 so that respective detection signals are input to the controller 30.

Figure 3:
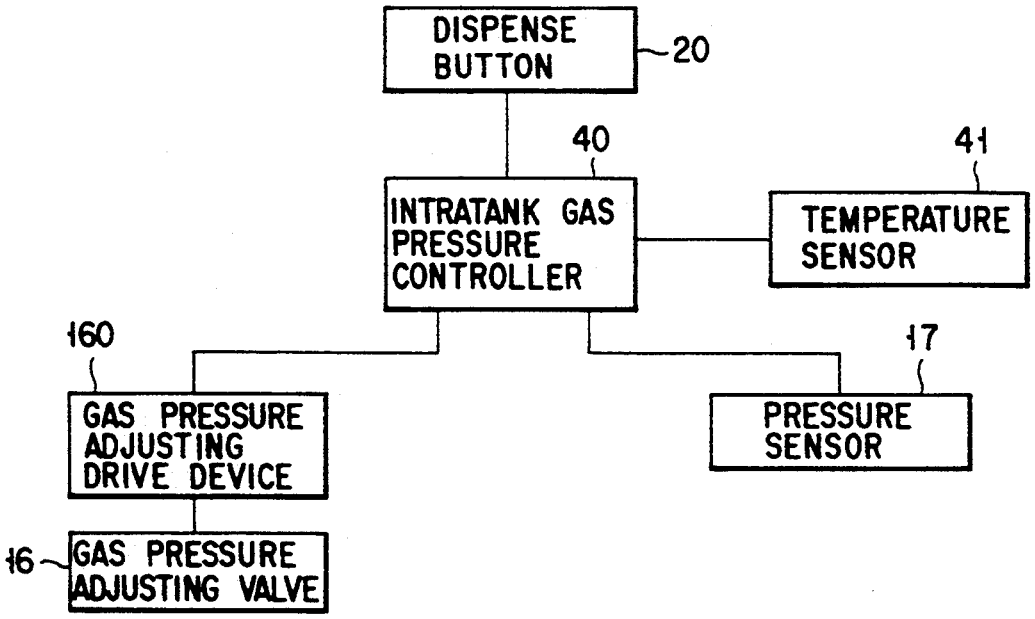
FIG. 3 is a block diagram showing another control system in FIG. 1.

As shown in FIG. 3, the gas pressure controller 40 is electrically connected to the temperature sensor 41, an electromagnetic type adjusting valve drive device 160 for opening and closing the gas pressure adjusting valve 16, the pressure sensor 17 and the dispensing button 20.

The gas pressure controller 40 includes a microcomputer, not shown in detail, and is adapted to initially store the temperature/pressure relation data, compute the pressure of the $CO_2$ gas supplied to the beverage tank (in this case, beer cask) 12 in accordance with the detection signal of the temperature sensor 41, compare the calculated value with the detection signal of the pressure sensor 17, and control the opening and closing of the gas pressure adjusting valve 16 so that a comparison value becomes zero.

As a result, the pressure of the $CO_2$ gas introduced from the $CO_2$ gas cylinder into the beverage tank 12 is so controlled as to be set to a computed value corresponding to the temperature of the bubbling beverage (in this case, draft beer).

Figure 4:
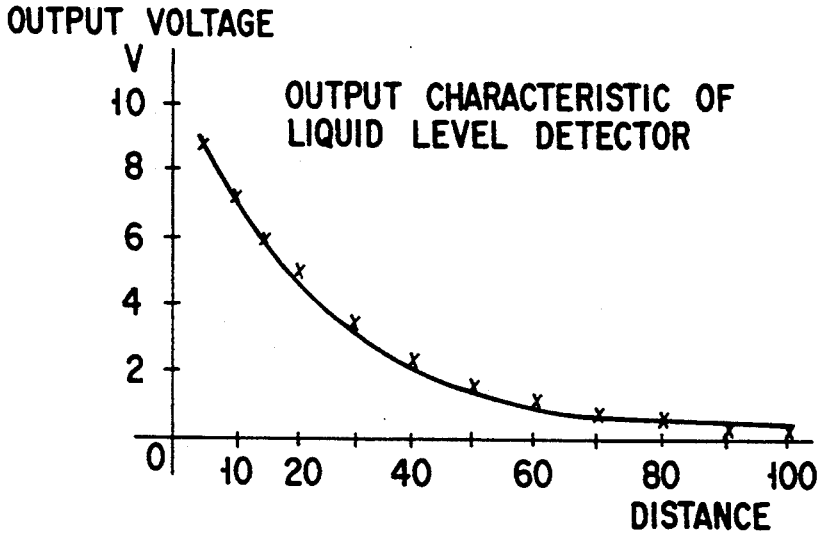
FIG. 4 is an explanative view showing the characteristic of a major section of the control system.

The liquid level detector 31 is of a photoelectric type, such as a reflective type light sensor and is adapted to convert an amount of light which varies in accordance with the detection distance as shown in FIG. 4 to an electric signal (in this case, a voltage) and detect the liquid level (or the bubble surface level) of the bubble beverage 10 in the container 19 by the magnitude of an electric signal. When an electric signal is input from the liquid level detector 31 to the controller 30, an operation signal is supplied from the controller 30 to the base tilting drive device 27, dispensing valve drive apparatus 21 and bubble valve drive device on the basis of the electric signal.

The operation of the dispensing apparatus thus arranged will be explained below with reference to the flow charts of FIGS. 5 and 6 and illustrations of FIGS. 7 to 9. The $CO_2$ gas in the $CO_2$ gas cylinder 13 is introduced into the gas drawing tube 15A under a pressure reduced by the constant pressure valve 14 and from there into the beverage tank (in this case, the beer cask) as shown in FIG. 1. At that time, the cooling device 2 is operated to place the cooling water 4 in the cooling water tank 3 in a properly cooled state of temperature.

In this state, upon the depression of the dispensing button 20, the bubbling beverage 10 is poured into the container 19 in a predetermined quantity which is placed on the rest base, as will be set forth below. At this time, the gas pressure controller 40 automatically controls the pressure of the $CO_2$ gas, which is supplied into the beverage tank 12, in a manner to set it to a proper $CO_2$ gas pressure level corresponding to the temperature of the bubbling beverage 10 and maintains, normally at a proper level, the amount of $CO_2$ gas which is dissolved in the bubbling beverage 10.

The procedure of controlling the intratank gas pressure in the gas pressure controller 40 will be explained below with reference to the flow chart of FIG. 5.

Figure 5:
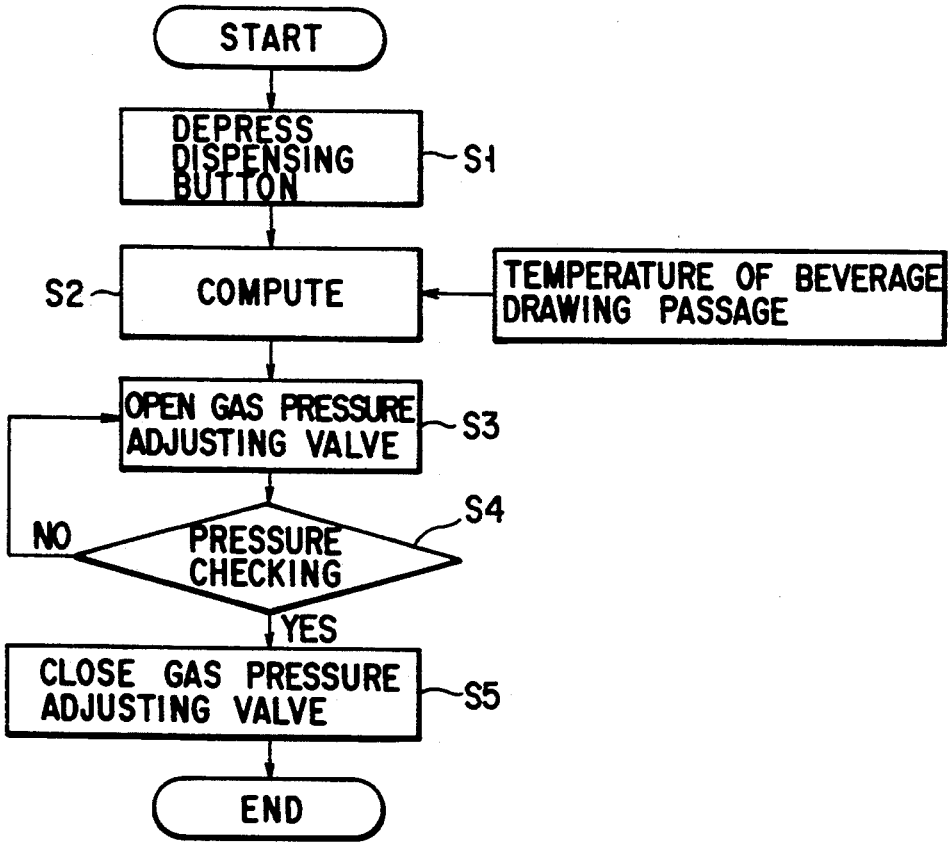
FIG. 5 is a flow chart showing a beverage dispensing operation of the present apparatus.

As shown in step S1 in FIG. 5 the dispensing button 20 is depressed and then at step S2 the microcomputer, not shown, computes the pressure of the $CO_2$ gas, on the basis of the temperature information from the temperature sensor, which is supplied to the beverage tank 12.

At step S3, the gas pressure adjusting valve 16 is opened, supplying the $CO_2$ gas which is pressure-reduced by the constant pressure valve 14 to the beverage tank 12 side through the gas drawing tube 15A, gas drawing tube 15C, gas drawing tube 15B and dispensing head 23.

At step S4, the microcomputer, not shown, in the gas pressure controller 40 compares the detection value of the pressure sensor 17 with the computed valve.

When a comparison valve becomes zero, the gas pressure adjusting valve 16 is closed as shown at step S5.

In this way, the gas pressure is controlled to the computed value corresponding to the temperature level detected by the temperature sensor 41. Where the bubbling beverage 10 is draft beer as in the present invention, the proper $CO_2$ gas pressure corresponding to the temperature of the bubbling beverage 10 is 1.2 to 1.5 kg/cm$^2$ for 10° C. draft beer, 2 to 2.5 kg/cm$^2$ for 20° C. draft beer and 3 to 3.5 kg/cm$^2$ for 30° C. draft beer in which case the content of the $CO_2$ gas in the draft beer is maintained to the 2.6 to 3 gas volumes.

By so doing, there is no possibility that a $CO_2$ gas in the bubbling beverage 10 will be released in the form of bubbles or, conversely, a $CO_2$ gas will be excessively absorbed in the bubbling beverage 10 so that, in either case, the resultant draft beer tastes flat. The $CO_2$ gas pressure can be adjustably corrected each time the dispensing button 20 is depressed.

For measuring the temperature of the bubbling beverage 10 in the beverage tank 12 by detecting the temperature of the beverage drawing tube 50 by means of the temperature sensor 41, the method is adopted which comprises measuring the temperature in the beverage drawing tube 50 both prior to dispensing the bubbling beverage and subsequent to dispensing the bubbling beverage, initially storing a relation of a rate of change of the prevailing temperature at that time to the temperature of the bubbling beverage 10 in the beverage tank 12, as data items, in the microcomputer in the gas pressure controller 40 and computing the temperature of the bubbling beverage 10 in the beverage tank 12, on the basis of the stored data items, from the temperature information obtained at the beverage drawing tube 50.

A temperature prevailing in the bubble beverage 10 in the beverage tank can also be computed from those information items which are measured from the temperature on the outer surface of the beverage tank 12.

Since the $CO_2$ gas is supplied into the beverage tank 12 under a pressure level corresponding to the temperature of the bubbling beverage 10 in the beverage tank 10, the bubbling beverage 10 in the beverage tank 12 is in a ready state to be dispensed or poured.

The dispensing operation will be explained below with reference to the flow chart of FIG. 6 and illustrations of FIGS. 7 to 9.

Figure 6:
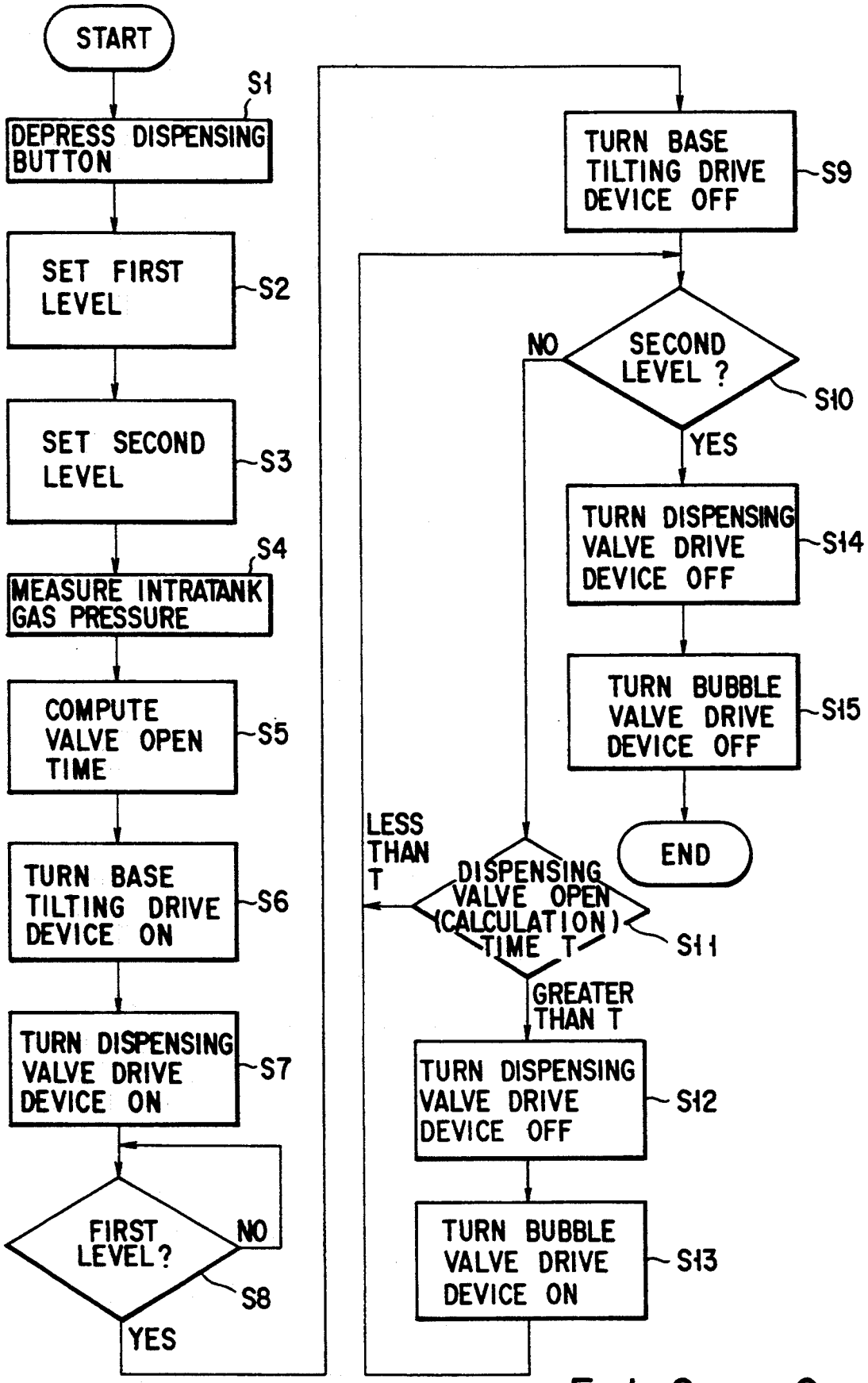
FIG. 6 is a flow chart showing a beverage dispensing operation of the present apparatus.
Figure 7:
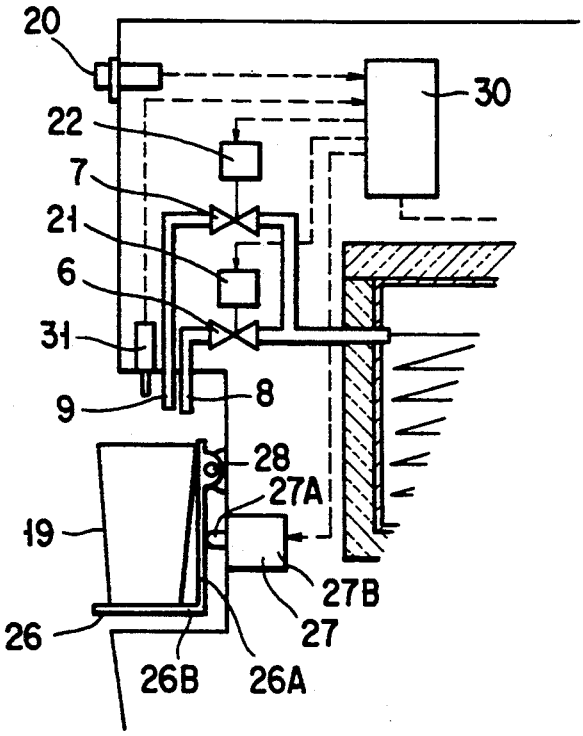
FIG. 7 is an explanative view showing a dispensing operation of the present apparatus.
Figure 8:
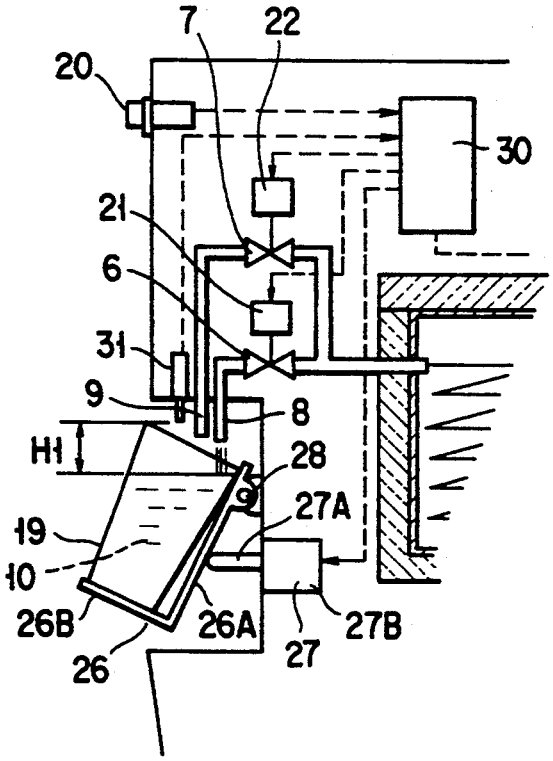
FIG. 8 is an explanative view showing a dispensing operation of the present invention.

First, the container 19, such as a mug, is placed on the rest base 26 at which time the rest base 26 is not in a tilted state, that is, the container 19 is placed in an upright state, as shown in FIG. 7. Then the dispensing button 20 is depressed as shown in step S1 in FIG. 6.

As shown in step S6 in FIG. 6, a first liquid level which is detected by the liquid level detector 31 is set and sent, as data, to the controller 30. The first liquid level means the liquid level or bubble surface level of the bubbling beverage (in this case, draft beer) about to be overflowed out of the container 19 when the container 19 is held in a tilted state. Each level is initially input as an electric signal corresponding to a detection distance H1 (see FIG. 8) in accordance with the output characteristic (see FIG. 4) of the liquid level detector 31.

Then as shown in step S3 in FIG. 6, a second liquid level which is detected by the liquid level detector 31 is input to the controller 30. The second liquid level is a level at which the dispensing or pouring of the beverage (in this case, draft beer) 10 or bubbles is finally stopped with a mugful of such draft beer 10 dispensed (poured) into the erect mug (container). The second liquid level is initially input as an electric signal corresponding to a detection distance H2 (see FIG. 9) to the controller.

At step S4, the pressure of the $CO_2$ gas supplied into the beverage tank (in this case, a beer cask) 12 is detected by the pressure sensor 17 and sent as a detected output to the controller 30.

At step S5, the "open" time of the dispensing valve (the dispensing time of the beverage), that is, the "ON" time of the dispensing valve drive device 21, is computed in accordance with the volume of the container 19. Then as shown at step S6, the base tilting drive device 27 is operated, causing the rest base 26 to be tilted as shown in FIG. 8 to allow the container 19 to be held at an angle of about 45° at max. to the dispensing outlet 8.

Then at step S7, the dispensing valve drive device 21 is responsive to a control signal from the controller 30 to be rendered ON, opening the dispensing valve and dispensing or pouring the bubbling beverage 10 into the container 19 via the dispensing outlet 8.

At this time, the beverage 10 being dispensed in the container 19 rises in the container 19, while flowing gradually along the inner wall of the container 19, and a $CO_2$ gas is partially released out of the beverage 10 in the form of bubbles so that a bubble layer is created on the upper side of the container 19.

The liquid level or bubble surface level in the container 19 rise gradually, while the beverage is being dispensed or poured into the container 19.

As shown in step S8, when the liquid level or bubble surface level of the beverage rise to the first liquid level which is set at step S2, it is detected by the liquid level detector 31 and a corresponding signal is sent to the controller 30. The controller 30 receives the detection signal and ON-controls the base tilting drive device 27 as shown in step S9, returning the container 19 on the rest base 26 back to an erect position as shown in FIG. 9.

Figure 9:
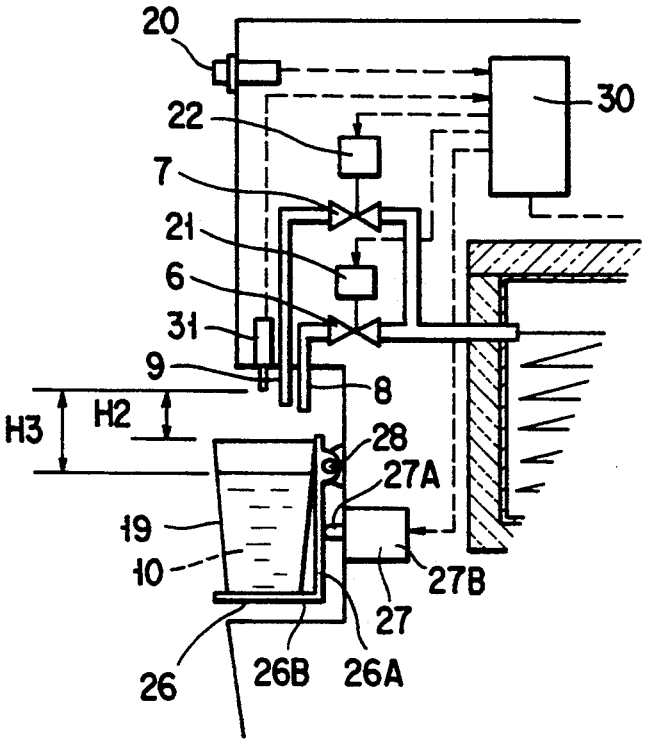
FIG. 9 is an explanative view showing a dispensing operation of the present invention.

With the container 19 in that erect position, the liquid level or bubble surface level of the beverage 10 in the container 19 is brought back to its normal surface level H3 as shown in FIG. 9 and the beverage 10 is further poured into the container 19.

As shown in step S10, when the liquid level or bubble surface level rises to the second liquid level initially set at set S3, it is detected by the liquid level detector 31 and a corresponding detection signal is sent to the controller 30. As shown in steps S14 and S15, the controller 30 sequentially turns off the dispensing valve drive device 21 and bubble valve drive device 22 and closes the dispensing valve 6 and bubble valve 7, thus stopping the dispensing or pouring of the beverage 10.

Where the liquid level detector 31 detects no second liquid level, that is, there is no lapse of the "open" time of the dispensing valve 6 as computed at step S5, a loop from step S10 to step S11 is run, continuing the dispensing of the beverage 10.

When the liquid level detector 31 detects a rise of the liquid level or bubble surface level to the second liquid level, the dispensing valve drive device 21 and bubble valve drive device 22 are sequentially turned off as shown in steps S14 and S15. As a result, the dispensing valve 6 and bubble valve 7 are closed, thus terminating the dispensing or pouring cycle of the bubbling beverage 10.

When the dispensing valve "open" time computed at step S5 is terminated during the run of the loop from step S10 to step S11, the dispensing valve drive device 21 is turned off, thus closing the dispensing valve 6.

After the dispensing valve drive device 21 has been turned off as shown at step S13, the bubble valve drive device 22 is turned "ON" and the bubble valve 7 is opened, thus dispensing bubbles into the container 19.

When the bubbles of the beverage in the container 19 rise to the second liquid level, it is detected by the liquid level detector 31 and a corresponding signal is supplied to the controller 30, thus turning the bubble valve drive device 22 "OFF" as shown at step S15. As a result, the bubble valve 7 is closed, thus terminating the dispensing or pouring of the beverage.

As already set out above, it is possible, according to the present invention, to automatically and controllably dispense the bubbling beverage in a proper liquid/bubble amount ratio without hand-gripping the container 19 to be poured with the bubbling beverage 10. The beverage dispensing apparatus can automatically and positively dispense a bubbling beverage without being overflowed out of the container and do so by a very simple operation of an inexperienced operator.

The pressure of a $CO_2$ gas in the beverage tank 12 can automatically be adjusted to a proper $CO_2$ gas level corresponding to a temperature of the bubbling beverage. Further, an amount of $CO_2$ gas dissolved in the bubbling beverage 10 can be maintained at all times in a proper state, thus dispensing the bubbling beverage 10 without losing any palatable taste.

Further, a different electrical signal is obtained in the liquid level detector, depending upon a detection distance as shown in FIG. 4. Some improvement, if being made as will be set forth below, enables an automatic dispensing operation to be done in accordance with the size of the container 19.

A plurality of dispensing buttons 20 may be provided for different kinds of containers 19 so that the corresponding signals can be input to the controller 30. In accordance with the respective container 19, the corresponding first and second liquid levels of the liquid level detector 31 are initially stored in the microcomputer of the controller 30. Similarly, the "open" times of the dispensing valve 6 can be stored, as corresponding computed values, in accordance with the size of the containers and first and second liquid levels of the liquid level device 31.

Any specific button 20, upon being depressed selectively in accordance with the container size, enables the bubbling beverage 10 to be poured into the container 19 of corresponding size.

Various changes or modifications of the present invention can be made, as will be set out below, based on the aforementioned embodiment.

Although the liquid level detector 31 has been explained as being of the photoelectric type, such as a light-reflective sensor, the present invention is not restricted thereto. For example, other proper types can be used, such as an ultrasound type.

Although the linear head 27A and stepping motor 27B have been employed as being comprised of the pressing member and moving means, respectively, in the base tilting drive device 27, other mechanical mechanisms may be provided, such as a pusher-equipped solenoid and air cylinder.

Although the dispensing valve drive device 21 and bubble valve drive device 22 have been explained as being of an electromagnetic type, other devices may be provided, such as an air cylinder.

If the percentage of an opening of the valve port is made adjustable, then the bubble valve 7, though being not shown in detail, can control the quality of bubbles of the draft beer. As the bubble valve 7 use may be made of an opening/closing valve having a small valve port or an opening/closing valve in combination with a constriction element.

Although the present invention has been explained in connection with the aforementioned embodiment equipped with the dispensing valve 6 and bubble valve 7, use may be made of, for example, a dispensing valve which can be set to three positions: "fully opened", "half-opened" and "fully closed." In this modification, if the dispensing valve is controllably set, by the valve drive device, to the "fully opened", "half-opening" or "fully closed" position by making a switching between the dispensing of the beverage and that of bubbles, then it is not necessary to provide a bubble valve 7 dedicated only to the formation of the bubbles.

Although, as the gas pressure adjusting valve 16 for adjusting the pressure of a $CO_2$ gas acting upon the beverage tank 12, the opening/closing valve is employed for simply opening or closing the associated tube to supply or stop the $CO_2$ gas, use may be made of an automatic pressure adjusting valve which is driven by, for example, a stepping motor. The automatic pressure adjusting valve receives a signal corresponding to a temperature of the bubbling beverage in the beverage tank 12 and can make the extent of a vacuum variable.

The present invention is not restricted to the aforementioned embodiment. Various changes or modification of the present invention can be made without departing from the spirit and scope of the present invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An apparatus for dispensing a sparkling or bubbling beverage, comprising:

an apparatus body having a beverage dispensing section where a dispensing outlet is provided for dispensing the bubbling beverage;

gas supplying means for supplying a $CO_2$ gas into a beverage-containing tank;

a beverage passage for drawing the beverage from the tank toward the dispensing outlet by a pressure of the $CO_2$ gas which is supplied from the gas supply means;

beverage cooling means for cooling the bubbling beverage which is drawn via the beverage passage toward the dispensing outlet;

a dispensing valve for opening/closing the beverage passage leading to the dispensing outlet;

a dispensing valve drive device for driving the dispensing valve to allow the dispensing valve to be opened or closed;

a rotatably displaceable rest base mounted below the beverage dispensing section with a beverage container placeable on said rest base so that the beverage is dispensed into the beverage container;

a base tilting drive device for tilting the rest base;

dispensing start signal input means for inputting a signal for starting the dispensing of the beverage into the container on the rest base;

a liquid level detector for detecting a bubble surface level or liquid level of the beverage dispensed into the container and for inputting level information to the controller; and a controller including a means for controlling the operation of the dispensing valve drive device and base tilting drive device in response to the signal input from the dispensing start signal input means and the level information from the liquid level detector to control the operation of both the base tilting drive device and the dispensing valve drive device in response to a bubble surface level or liquid level of the beverage so as to move the beverage container from a tilted position to an erect position dependent upon the liquid level or bubble surface within the container;

wherein the controller operates the base tilting drive device, upon receiving the signal from the dispensing start signal input means, to allow the container on the rest base to be tilted, while opening the dispensing valve through the operation of the valve drive device to dispense the beverage into the beverage container, controls the base tilting drive device so that the beverage container is held erect after the bubble surface level or liquid level of the beverage has been brought to a predetermined level, and controls the dispensing valve to close the dispensing valve after the bubble or beverage again dispensed in the erect position of the container has been brought to a predetermined level.

2. The apparatus according to claim 1, wherein the base tilting drive device comprises a movable pressing member having its forward end abutted against a rear surface of the rotatably displaceable rest base to enable the rest base to be moved along its displacing direction and movable means for moving the movable pressing member along a direction in which the rest base is displaced.

3. The apparatus according to claim 1, wherein the liquid level detector is comprised of a light-reflective type sensor which produces a different electrical signal corresponding to a detection distance involved.

4. An apparatus for dispensing a sparkling or bubbling beverage, comprising:

an apparatus body having a beverage dispensing section where a dispensing outlet is provided for dispensing the bubbling beverage;

gas supplying means for supplying $CO_2$ gas in a beverage-containing tank;

a beverage passage for drawing the beverage from the tank toward the dispensing outlet by the pressure of the $CO_2$ gas which is supplied from the gas supply means;

beverage cooling means for cooling the bubbling beverage which is drawn via the beverage passage toward the dispensing outlet;

a dispensing valve for opening/closing the beverage passage leading to the dispensing outlet;

a dispensing valve drive device for driving the dispensing valve to allow the dispensing valve to be opened or closed;

a rotatably displaceable rest base mounted below the beverage dispensing section with a beverage container placeable on said rest base so that the beverage is dispensed into the beverage container;

a base tilting drive device for tilting the rest base;

dispensing start signal input means for inputting a signal for starting the dispensing of the beverage into the container on the rest base;

gas pressure detecting means for detecting the pressure of the gas supplied into the tank;

intratank gas pressure controller for controlling a pressure in the tank in accordance with a temperature of the beverage drawn into the beverage cooling means;

a controller for controlling an operation of the dispensing valve drive means and base tilting drive device by those signal input by the dispensing start signal input means and gas pressure detecting means;

temperature detecting means for detecting temperature of the beverage drawn into the beverage cooling means;

a gas pressure adjusting valve for adjusting pressure of the $CO_2$ gas supplied into the tank by the gas supplying means;

an adjusting valve drive device for computing the temperature in the tank from temperature information of the temperature detecting means and controlling the gas pressure adjusting valve to allow a proper gas pressure which corresponds to the beverage temperature to be applied to an interior of the tank; and gas pressure detecting means for detecting a gas pressure adjusted by the gas pressure adjusting valve and for giving a feedback signal according to whether the adjusting valve drive device is properly operated or not;

wherein the controller receives a signal from the gas pressure detecting means upon the inputting of the dispensing start signal input means, computes a beverage dispensing time in accordance with a pressure of the $CO_2$ gas supplied into the tank, drives the base tilting drive device to hold the container to be held tilted, drives the dispensing valve drive device to dispense the beverage into the container, while opening the dispensing valve, operates the base tilting drive device, when bubble surface or liquid level of the beverage which is dispensed into the container rises to a first, predetermined level, to bring the container back to an erect position, and operates the dispensing valve drive device at a completion of a computed dispensing time to close the dispensing valve, wherein the base tilting drive device comprises a movable pressing member having its forward end abutted against a rear surface of the rotatably displaceable rest base to enable the rest base to be moved along its displacing direction and movable means which comprises a stepping motor for moving the movable pressing member along a direction in which the rest base is displaced.

5. The apparatus according to claim 4, wherein the base tilting drive device rotatably displaces the rest base such that the rest base is first held tilted to allow the beverage to be dispensed along an inner wall of the container and then the container is gradually brought back to an erect position without the beverage being flowed out of the container.

6. The apparatus according to claim 4, wherein the bubbling beverage is draft beer and a $CO_2$ gas pressure on the draft beer is 1.2 to 1.5 kg/cm$^2$ for 10° C. draft beer, 2 to 2.5 kg/cm$^2$ for 20° C. draft beer and 3 to 3.5 kg/cm$^2$ for 30° C. draft beer wherein a $CO_2$ gas content in the beer is maintained to be 2.6 to 3 gas volumes.

7. An apparatus for dispensing a sparkling or bubbling beverage, comprising:

an apparatus body having a beverage dispensing section where dispensing beverage and bubble outlets are provided for dispensing the bubbling beverage;

gas supplying means for supplying a $CO_2$ gas in a beverage-containing tank;

a beverage passage for drawing the beverage from the tank toward the dispensing outlets by the pressure of the $CO_2$ gas which is supplied from the gas supply means;

beverage cooling means for cooling the bubbling beverage which is drawn via the beverage passage toward the dispensing outlets;

a dispensing valve for opening/closing the beverage passage leading to the dispensing outlet;

dispensing valve drive device for driving the dispensing valve to allow the dispensing valve to be opened or closed:

a bubble valve for opening or closing the beverage passage leading to the bubble outlet;

a bubble valve drive device for opening or closing the bubble valve;

a rotatably displaceable rest base mounted below the beverage dispensing section with a beverage container placeable on said rest base so that the beverage is dispensed into the beverage container;

a base tilting drive device for tilting the rest base;

dispensing start signal input means for inputting a signal for starting the dispensing of the beverage into the container on the rest base;

gas pressure detecting means for detecting a pressure of the gas supplied into the tank;

an intratank gas pressure container for controlling a pressure in the tank in accordance with a temperature of the beverage drawn into the beverage cooling means;

a liquid level detector for detecting a bubble surface or liquid level of the beverage dispensed into the container; and a controller including a means for controlling an operation of the base tilting drive device and dispensing valve drive device by those signals input by the gas pressure detecting means and liquid level detector to control the operation of both the base tilting drive device and the dispensing valve drive device in response to a bubble surface level or liquid level of the beverage so as to move the beverage container from a tilted position to an erect position dependent upon the liquid level or bubble surface within the container;

wherein the controller receives a signal from the gas pressure detecting means upon the inputting of the dispensing start signal input means, computes a beverage dispensing start signal input means, computes a beverage dispensing time in accordance with a pressure of the $CO_2$ gas supplied into the tank, drives the base tilting drive device on the rest base to hold the container to be held tilted, drives the dispensing valve drive device to dispense the beverage into the container, while opening the dispensing valve, operates the base tilting drive device, when it is detected that a bubble surface or liquid level of the beverage which is dispensed into the container rises to a first, predetermined level, to bring the container back to an erect position, and operates the dispensing valve drive device at a completion of a computed dispensing time to close the dispensing valve, operates the bubble valve drive device to dispense bubbles, while opening the bubble valve, to a second level, and closes the bubble valve when it is detected that the bubble rises to that second level.

8. The apparatus according to claim 7, wherein the intratank gas pressure controller comprises temperature detecting means for detecting a temperature of the beverage drawn into the beverage cooling means; a gas pressure adjusting valve for adjusting a pressure of a $CO_2$ gas supplied into the beverage tank by the gas supplying means; an adjusting valve drive device for computing a temperature of the beverage in the tank from temperature information of the temperature detecting means and controlling the gas pressure adjusting valve to allow a proper gas pressure corresponding to the temperature of the beverage to be applied to the interior of the tank; and gas pressure detecting means for detecting a gas pressure adjusted by the gas pressure adjusting valve and giving a feedback according to whether the adjusting valve drive device is properly operated or not.

9. An apparatus for dispensing a sparkling or bubbling beverage, comprising:

an apparatus body having a beverage dispensing section where a dispensing outlet is provided for dispensing the bubbling beverage;

gas supplying means for supplying a $CO_2$ gas into a beverage-containing tank;

a beverage passage for drawing the beverage from the tank toward the dispensing outlet by a pressure of the $CO_2$ gas which is supplied from the gas supply means;

beverage cooling means for cooling the bubbling beverage which is drawn via the beverage passage toward the dispensing outlet;

a dispensing valve for opening/closing the beverage passage leading to the dispensing outlet;

a dispensing valve drive device for driving the dispensing valve to allow the dispensing valve to be opened or closed;

a rotatably displaceable rest base mounted below the beverage dispensing section with a beverage container placeable on said rest base so that the beverage is dispensed into the beverage container;

a base tilting drive device for tilting the rest base;

dispensing start signal input means for inputting a signal for starting the dispensing of the beverage into the container on the rest base;

a gas pressure detecting means for detecting a pressure of the gas supplied into the tank;

an intratank gas pressure controller for controlling a pressure in the tank in accordance with a temperature of the beverage drawn into the beverage cooling means;

a liquid level detector for detecting a bubble surface or liquid level of the beverage dispensed into the container; and a controller including a means for controlling an operation of the base tilting drive device and dispensing valve drive device by those signals input by the gas pressure detecting means and liquid level detector to control the operation of both the base tilting drive device and the dispensing valve drive device in response to a bubble surface level or liquid level of the beverage so as to move the beverage container from a tilted position to an erect position dependent upon the liquid level or bubble surface within the container;

wherein the controller receives a signal from the gas pressure detecting means upon the inputting of the dispensing start signal input means, computes a beverage dispensing time in accordance with the pressure of the $CO_2$ gas supplied into the beverage container, drives the base tilting drive device on the rest base to hold the container to be held tilted, drives the dispensing valve drive device to dispense the beverage into the container, while opening the dispensing valve, operates the base tilting drive device, when it is detected that a bubble surface or liquid level of the beverage which is dispensed into the container rises to a first, predetermined level, to bring the container back to an erect position, operates the dispensing valve drive device at a completion of a computed dispensing time to fully close the dispensing valve, operates the dispensing valve drive device to a second level initially set by the liquid level detector to half open the dispensing valve so that bubbles are dispensed and operates the dispensing valve drive device, upon receipt of a detection signal indicating that the bubbles rise to the second level, so that the dispensing valve is closed.

10. The apparatus according to claim 9, wherein the intratank gas pressure controller comprises temperature detecting means for detecting a temperature of the beverage drawn into the beverage cooling means; a gas pressure adjusting valve for adjusting a pressure of a $CO_2$ gas supplied into the beverage tank by the gas supplying means; an adjusting valve drive device for computing a temperature of the beverage in the tank from temperature information of the temperature detecting means and controlling the gas pressure adjusting valve to allow a proper gas pressure corresponding to the temperature of the beverage to be applied to the interior of the tank; and gas pressure detecting means for detecting a gas pressure adjusted by the gas pressure adjusting valve and giving a feedback according to whether the adjusting valve drive device is properly operated or not.

* * * * *